US005749401A

United States Patent [19]

Shinya et al.

[11] Patent Number: 5,749,401

[45] Date of Patent: May 12, 1998

[54] POWDER FILLING METHOD

[75] Inventors: Nozomi Shinya, Toyonaka; Masami Eda, Kobe, both of Japan

[73] Assignee: Minolta Co., Ltd., Osaka, Japan

[21] Appl. No.: 727,299

[22] Filed: Oct. 8, 1996

[30] Foreign Application Priority Data

Oct. 12, 1995 [JP] Japan ..... 7-292202

[51] Int. Cl.[6] ..... B65B 1/26

[52] U.S. Cl. ..... 141/80; 141/5; 141/73; 141/67

[58] Field of Search ..... 141/1, 5, 7, 67, 141/68, 71, 73, 80

[56] References Cited

U.S. PATENT DOCUMENTS

| | | | |
|---|---|---|---|
| 2,611,938 | 9/1952 | Hansberg | 141/71 |
| 3,260,285 | 7/1966 | Vogt | 141/67 |
| 3,396,762 | 8/1968 | Paton | 141/7 |
| 3,788,368 | 1/1974 | Geng et al. | 141/67 |
| 4,106,533 | 8/1978 | Herzig | 141/1 |
| 4,212,331 | 7/1980 | Benatar | 141/67 |
| 4,872,493 | 10/1989 | Everman | 141/73 |

*Primary Examiner*—J. Casimer Jacyna

*Attorney, Agent, or Firm*—Burns, Doane, Swecker & Mathis, LLP

[57] ABSTRACT

In a powder filling method for supplying the powder from a powder supply hopper into a container, the air inside the hopper and/or the container is pressured and then restored to an atmospheric pressure by discharging the pressured air in the hopper and/or the container. With this method, even a powder of an inferior filling performance can be filled into a container to a high density.

12 Claims, 4 Drawing Sheets

10
21
20
1

30
31
31a
33
21
20
32a
32
1

10
20
1

POWDER FILLING METHOD

BACKGROUND OF THE INVENTION

1. Field of the Invention

The present invention relates to a powder filling method for filling a stowing container internally with a powder by supplying the powder from a powder supply means into the stowing container, and in particular, to a powder filling method capable of filling the stowing container to a high density even with a powder such as toner which has a low slack apparent specific gravity relative to its true specific gravity leading to an inferior filling performance.

2. Description of the Related Art

Conventionally, filling of a stowing container with a powder has been performed by supplying the powder from a powder supply means such as a hopper into the stowing container.

However, in the case of a powder such as toner which has a low slack apparent specific gravity relative to its true specific gravity leading to an inferior filling performance, there has been a problem that merely supplying the powder from the powder supply means such as a hopper into the stowing container cannot fill the stowing container with the powder to a high density.

SUMMARY OF THE INVENTION

A principal object of the present invention is to improve the efficiency of filling a stowing container with a powder.

Another object of the present invention is to fill the stowing container to a high density even with a powder which has a low slack apparent specific gravity relative to its true specific gravity leading to an inferior filling performance.

These and other objects of the present invention are accomplished by a method for increasing a bulk density of powder comprising the following steps of supplying powder into an airtight space, pressuring air of the space, and restoring the air of the space to an atmospheric pressure.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Preferred embodiments of the powder filling method pertaining to the present invention will be concretely described below with reference to the accompanying drawings. With inventive and comparative examples enumerated as follows, it will be evident that each stowing container is internally filled with a powder to a high density when the stowing container is filled with the powder by the powder filling method according to each embodiment of the present invention.

First Embodiment

Figure 1:
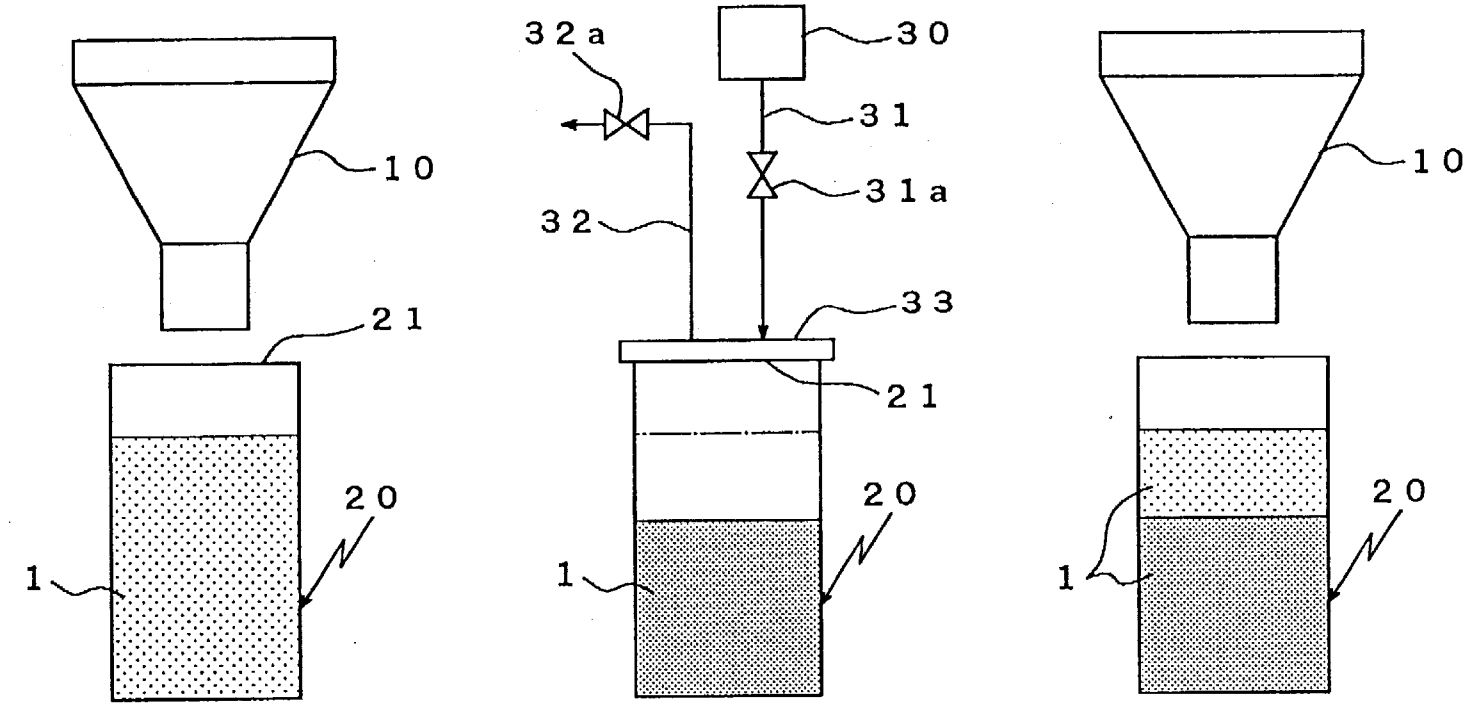
FIGS. 1(A), 1(B) and 1(C) are schematic explanatory views showing the processes of filling a stowing container internally with a powder by a powder filling method according to a first embodiment of the present invention.

According to the powder filling method of the present embodiment, as shown in FIG. 1(A), a specified amount of powder 1 such as toner is supplied from a powder supply means 10 such as a hopper storing therein the powder 1 into a stowing container 20.

Subsequently, as shown in FIG. 1(B), an opening 21 of the stowing container 20 to which the specified amount of powder 1 has been supplied as described above is closed by a lid 33 provided with a supply pipe 31 for supplying air fed from a pressuring compressor 30 into the stowing container 20 and a discharge pipe 32 for discharging the air pressurized in the stowing container 20. Then, in the above state, a valve 31*a* provided at the supply pipe 31 is opened, and air is supplied from the compressor 30 through the supply pipe 31 into the stowing container 20 to internally pressurize the stowing container 20. Thereafter, the valve 31*a* at the supply pipe 31 is closed and a valve 32*a* provided at the discharge pipe 32 is opened to discharge the air pressurized in the stowing container 20 to the outside through the discharge pipe 32, thereby allowing the stowing container 20 to internally restore the atmospheric pressure.

In the above case, when the stowing container 20 is internally pressurized as described above, the powder 1 in the stowing container 20 is compressed to be filled to a higher density. Subsequently, when the atmospheric pressure is restored in the stowing container 20, the air that has existed in the powder 1 is discharged to the outside, so that the density of the powder 1 in the stowing container 20 is increased to reduce the volume of the powder 1 in the stowing container 20, thereby lowering the powder surface.

According to the present embodiment, after reducing the volume of the powder 1 in the stowing container 20 to lower the powder surface as described above, more powder is supplied from the powder supply means 10 into the stowing container 20 as shown in FIG. 1(C).

Consequently, according to the powder filling method of the present embodiment, the stowing container 20 is filled with a greater amount of the powder 1 to a high density.

According to the powder filling method of the present embodiment, a toner produced as follows was used as the powder 1 to be supplied into the stowing container 20, and the bulk density of the toner filled in the stowing container 20 was measured with the internal pressurizing conditions of the stowing container 20 varied.

In the present case, to produce the toner, 100 parts by weight of styrene-n-butylmethacrylate resin (Tm 132° C., Tg: 60° C.), five parts by weight of nigrosine-based dye (nigrosine-based EX produced by Orient Chemical Industries), five parts by weight of low molecular weight polypropylene (biscol TS500 produced by Sanyo Chemical Industries) and 10 parts by weight of carbon black (MA#8 produced by Mitsubishi Chemical Industries) were used. These materials were mixed together by an ordinary method, and the resulting mixture was kneaded. The kneaded material was pulverized to obtain toner particles, and thereafter 0.15 part by weight of silica (R-972 produced by Nihon Aerosil K. K.) was added to 100 parts by weight of the toner particles for post-treatment to obtain a toner having a mean particle diameter of 10 μm. The slack apparent specific gravity of the toner was measured by a powder tester produced by Hosokawa Micron K. K., and the measurement result was 0.395 g/cc.

Figure 2:
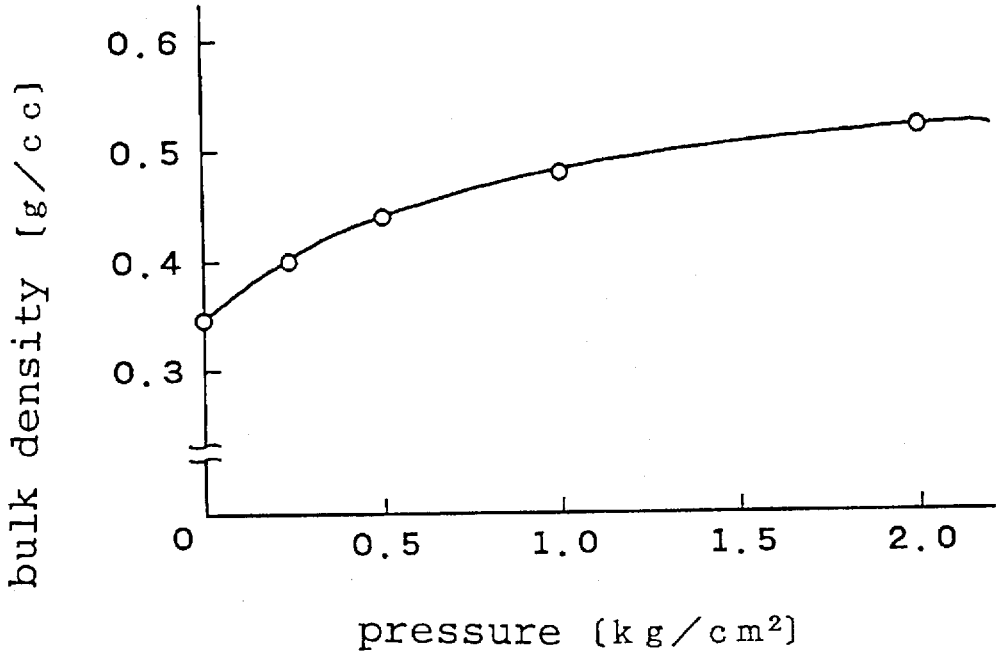
FIG. 2 is a graph showing the relation of a pressure that is to be applied to the inside of the stowing container and varied relative to the bulk density of toner filled inside the stowing container according to the powder filling method of the first embodiment.

Then, the thus obtained toner was supplied by 262 grams at a supply rate of 60 g/s from the powder supply means 10 into the stowing container 20 having a capacity of 1000 cc, and thereafter air was supplied into the stowing container 20 as described above to increase the internal pressure of the stowing container 20 at a pressurizing speed of 0.6 kg/cm$^2$.s to a specified pressure. Thereafter, the air pressurized in the stowing container 20 was discharged to restore the atmospheric pressure in the stowing container 20 at a depressurizing speed of 0.2 kg/cm$^2$.s, and a relation between the pressure in the pressurizing stage and the bulk density of the toner filled in the stowing container 20 was examined, the result being shown in FIG. 2.

According to the result, the greater the pressure applied internally to the stowing container 20 supplied with the toner is, the higher the bulk density of the toner filled in the stowing container 20 will be.

Using the above toner as the powder 1 to be filled in the stowing container 20, first and second examples in which the stowing container 20 is internally filled with the toner according to the powder filling method of the present embodiment will be compared below with first and second comparative examples in which the stowing container 20 is internally filled with the toner without performing the restoration of the atmospheric pressure after internally pressurizing the stowing container 20.

First Example and First Comparative Example

In each of the first example and the first comparative example, a stowing container 20 having a capacity of 750 cc was used, and the toner was supplied by 262 grams at a supply rate of 60 g/s from the powder supply means 10 into the stowing container 20. Subsequently, in the first example, air was supplied from the compressor 30 into the stowing container 20 through the supply pipe 31 as described above to increase the internal pressure of the stowing container 20 at a pressurizing speed of 0.6 kg/cm$^2$.s to a pressure of 2 kg/cm$^2$. Thereafter, the atmospheric pressure was restored in the stowing container 20 at a depressurizing speed of 0.2 kg/cm$^2$.s. On the other hand, in the first comparative example, the stowing container 20 supplied with the toner was left for a time corresponding to that of the first example without internally pressurizing nor depressurizing the stowing container 20.

Subsequently, a second supply of the toner was effected from the powder supply means 10 into each stowing container 20 to fill each stowing container 20 with the toner up to an identical position of height, and the filling amount of the toner filled at the second time and a total filling amount of the toner in the stowing container 20 were obtained. The filling amount at the second time was 86 grams and the total filling amount was 348 grams in the first example, while in the first comparative example the filling amount at the second time was 14 grams and the total filling amount was 276 grams.

Second Example and Second Comparative Example

In each of the second example and the second comparative example, a stowing container 20 having a capacity of 1400 cc was used, and the toner was supplied by 490 grams at a supply rate of 60 g/s from the powder supply means 10 into the stowing container 20. Subsequently, in the second example, the internal pressure of the stowing container 20 was increased at a pressurizing speed of 0.6 kg/cm$^2$.s to a pressure of 2 kg/cm$^2$ similarly to the first example. Thereafter, the atmospheric pressure was restored in the stowing container 20 at a depressurizing speed of 0.2 kg/cm$^2$.s. On the other hand, in the second comparative example, the stowing container 20 supplied with the toner was left for a time corresponding to that of the second example without internally pressurizing nor depressurizing the stowing container 20.

Subsequently, a second supply of the toner was effected from the powder supply means 10 into each stowing container 20 to fill each stowing container 20 with the toner up to an identical position of height, and the filling amount of the toner filled at the second time and a total filling amount of the toner in the stowing container 20 were obtained. The filling amount at the second time was 160 grams and the total filling amount was 650 grams in the second example, while in the second comparative example the filling amount at the second time was 26 grams and the total filling amount was 516 grams.

As is apparent from the above results, according to the powder filling method of the first and second examples in which the stowing container 20 is internally pressurized after supplying the toner into the stowing container 20 and then the atmospheric pressure is restored, the filling amount of the toner at the second time was increased in comparison with the powder filling method of the first and second comparative examples in which no such operation has been performed. Consequently, the stowing container 20 was allowed to be internally filled with a greater amount of toner to a high density.

Figure 3:
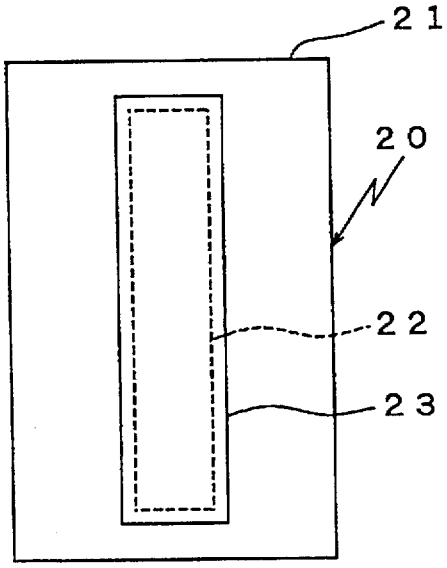
FIG. 3 is a schematic view showing a modification example of the stowing container to be used according to the powder filling method of the first embodiment.

The pressurization is performed by supplying air into only the stowing container 20 to internally pressurize the stowing container 20 supplied with the powder 1 according to the powder filling method of the present embodiment. However, in the case of a stowing container 20 having a weak physical strength or in the case of a stowing container 20 in which a feed opening 22 for supplying the powder 1 is provided other than the aforementioned opening 21 and the feed opening 22 is sealed with a seal material 23 such as a tape as shown in FIG. 3, when the stowing container 20 is internally pressurized by supplying air into the stowing container 20 as described above, it is feared that the stowing container 20 may be destroyed or the seal material 23 attached to the stowing container 20 may peel off to cause the powder 1 to spout from the feed opening 22.

Figure 4:
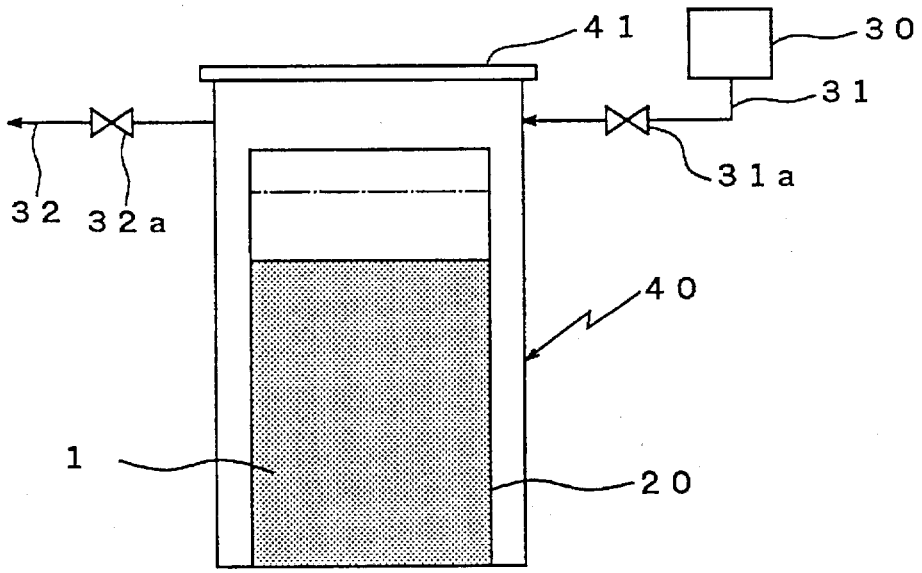
FIG. 4 is a schematic view showing a state in which the pressure inside the stowing container supplied with the powder is increased and decreased in a pressure container according to the powder filling method of the first embodiment.

Therefore, in such a case, it is preferable to install the stowing container 20 in a pressure resistant container 40 as shown in FIG. 4, supply air from the compressor 30 into the pressure resistant container 40 through the supply pipe 31 with the pressure resistant container 40 sealed by a lid 41 as described above, pressurize the inside and the environment of the stowing container 20 supplied with the powder 1 as described above, and thereafter discharge the pressurized air inside the pressure resistant container 40 to the outside through the discharge pipe 32 for the restoration of the atmospheric pressure inside the stowing container 20.

According to the first embodiment of the present invention as described above, by supplying the powder into the stowing container and thereafter internally pressurizing the stowing container, the powder in the stowing container is compressed to be filled to a higher density. Subsequently, when the atmospheric pressure is restored in the stowing container, the air that has existed in the powder is discharged, so that the stowing container is allowed to be internally filled to a high density even with a powder such as toner which has a low slack apparent specific gravity relative to its true specific gravity.

When the density of the powder filled in the stowing container is thus increased, the volume of the powder in the stowing container is reduced, and by supplying the powder again into the stowing container, the stowing container is allowed to be filled with a greater amount of powder.

Second Embodiment

Figure 5:
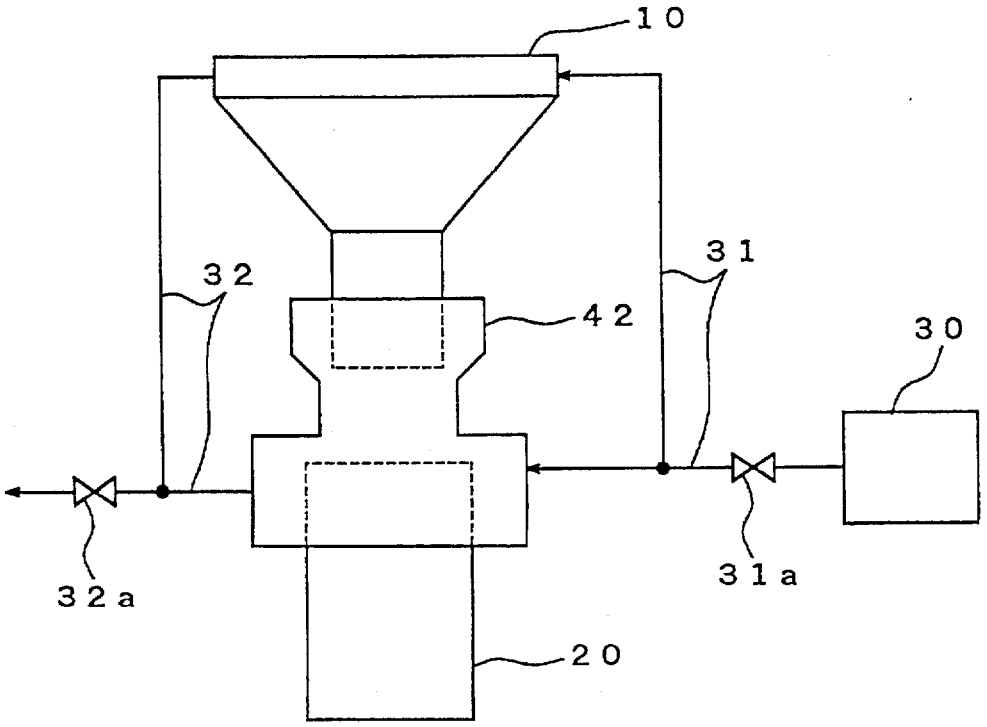
FIG. 5 is a schematic explanatory view showing a state in which a stowing container is filled with a powder supplied from a powder supply means by a powder filling method according to a second embodiment of the present invention.

According to the powder filling method of the present embodiment, as shown in FIG. 5, a connection member 42 is provided so that it seals a lower portion of a powder supply means 10 for supplying a powder 1 such as toner into a stowing container 20 and an upper portion of the stowing container 20, and an upper surface of the powder supply means 10 is made closable. Furthermore, a supply pipe 31 for supplying air fed from a pressurizing compressor 30 and a discharge pipe 32 for discharging the pressurized air are connected to the powder supply means 10 and the connection member 42.

To internally fill the stowing container 20 with the powder 1 according to the powder filling method of the present embodiment, air is supplied at least once from the compressor 30 through the supply pipe 31 to the powder supply means 10 and the connection member 42 while supplying the powder 1 from the powder supply means 10 into the stowing container 20, and after internally pressurizing the powder supply means 10 and the stowing container 20, a valve 32*a* provided at the discharge pipe 32 is opened to restore the atmospheric pressure in the powder supply means 10 and the stowing container 20.

In the present case, when the powder supply means 10 and the stowing container 20 are internally pressurized as described above, the powder 1 in the powder supply means 10 and the stowing container 20 is compressed to a greater density. Subsequently, when the atmospheric pressure is restored in the powder supply means 10 and the stowing container 20, the air that has existed in the powder 1 is discharged to the outside, so that the bulk density of the powder 1 in the powder supply means 10 and the stowing container 20 is increased to allow the stowing container 20 to be filled with a greater amount of the powder 1 to a high density.

Then, using the above toner as the powder 1 to be filled in the stowing container 20, third and fourth examples in which the stowing container 20 is internally filled with the toner according to the powder filling method of the present embodiment will be compared below with third and fourth comparative examples in which the stowing container 20 is internally filled with the toner without performing the restoration of the atmospheric pressure after internally pressurizing the powder supply means 10 and the stowing container 20.

Third Example and Third Comparative Example

In each of the third example and the third comparative example, a stowing container 20 having a capacity of 1400 cc was used, and the toner was supplied at a supply rate of 60 g/s from the powder supply means 10 into the stowing container 20.

Then, in the third example, the toner was supplied from the powder supply means 10 into the stowing container 20 as described above, and air was supplied from the compressor 30 through the supply pipe 31 into the powder supply means 10 and the connection member 42 to internally pressurize the powder supply means 10 and the stowing container 20. The pressurization was effected until each of the powder supply means 10 and the stowing container 20 came to have an internal pressure of 2 kg/cm$^2$ six seconds after the supply of the toner, and thereafter the pressurized air was discharged through the discharge pipe 32 to restore the atmospheric pressure in the powder supply means 10 and the stowing container 20. Subsequently, the powder supply means 10 and the stowing container 20 were internally pressurized again as described above until each of the powder supply means 10 and the stowing container 20 came to have an internal pressure of 1 kg/cm$^2$ ten seconds after the supply of the toner, and thereafter the air was discharged as described above to restore the atmospheric pressure in the powder supply means 10 and the stowing container 20, so that the stowing container 20 was internally filled with the toner to a specified height.

On the other hand, in the third comparative example, the powder supply means 10 and the stowing container 20 were internally pressurized, and thereafter the toner was supplied from the powder supply means 10 into the stowing container 20 without performing the restoration of the atmospheric pressure, so that the stowing container 20 was internally filled with the toner to a specified height.

In the third example and the third comparative example, the filling amount of the toner filled in each stowing container 20 was measured. As a result, the stowing container 20 was internally filled with 672 grams of the toner according to the method of the third example, while according to the method of the third comparative example the container was filled with only 490 grams of the toner. Therefore, by filling the container with the toner in a manner as in the third example, the stowing container 20 was allowed to be internally filled with a greater amount of toner to a high density.

Furthermore, by setting the pressure at the second time to a pressure lower than the pressure at the first time when internally pressurizing the powder supply means 10 and the stowing container 20 as in the third example, the possible discharge of the toner together with air was suppressed in restoring the atmospheric pressure in the stowing container 20 with the stowing container 20 being filled with a greater amount of toner.

Fourth Example and Fourth Comparative Example

In each of the fourth example and the fourth comparative example, a stowing container 20 having a capacity of 3900 cc was used, and the toner was supplied at a supply rate of 60 g/s from the powder supply means 10 into the stowing container 20.

Then, in the fourth example, the toner was supplied from the powder supply means 10 into the stowing container 20, similar to the third example, as described above, and air was supplied into the powder supply means 10 and the connection member 42 to internally pressurize the powder supply means 10 and the stowing container 20. The pressurization was effected until each of the powder supply means 10 and the stowing container 20 came to have an internal pressure of 2 kg/cm$^2$ at 20 seconds after the supply of the toner, and thereafter the pressurized air was discharged to restore the atmospheric pressure in the powder supply means 10 and the stowing container 20. Subsequently, the powder supply means 10 and the stowing container 20 were internally pressurized again until each of the powder supply means 10 and the stowing container 20 came to have an internal pressure of 2 kg/cm$^2$ at 28 seconds after the supply of the toner, and thereafter the pressurized air was discharged to restore the atmospheric pressure in the powder supply means 10 and the stowing container 20, so that the stowing container 20 was internally filled with the toner to a specified height.

On the other hand, in the fourth comparative example, the powder supply means 10 and the stowing container 20 were internally pressurized, and thereafter the toner was supplied from the powder supply means 10 into the stowing container 20 without performing the restoration of the atmospheric pressure as described above, so that the stowing container 20 was internally filled with the toner to a specified height.

In the fourth example and the fourth comparative example, the filling amount of the toner filled in each stowing container 20 was measured. As a result, the stowing container 20 was internally filled with 1914 grams of the toner according to the method of the fourth example, while according to the method of the fourth comparative example the container was filled with only 1365 grams of the toner. Therefore, by filling the container with the toner as in the fourth example, the stowing container 20 was allowed to be internally filled with a greater amount of toner to a high density.

Also, according to the powder filling method of the present embodiment, in the case of a stowing container 20 having a weak physical strength or in the case of a stowing container 20 in which a feed opening 22 for supplying the powder 1 into the stowing container 20 is provided and the feed opening 22 is sealed with a seal material 23 such as a tape, it is proper to install the stowing container 20 in a pressure resistant container 40 and internally pressurize the pressure resistant container 40 similarly to the aforementioned first embodiment.

According to the second embodiment of the present invention as described above, when the powder supply means for supplying the stowing container with the powder and the stowing container are internally pressurized in the course of filling the stowing container with the powder, the powder supplied from the powder supply means into the stowing container as well as the powder supplied into the stowing container are compressed to an increased density. Subsequently, when the atmospheric pressure is restored in the powder supply means and the stowing container, the air that has existed in the powder is discharged. Therefore, the stowing container is allowed to be internally filled to a high density even with a powder such as toner which has a low slack apparent specific gravity relative to its true specific gravity.

Furthermore, in the second embodiment, the stowing container can be also filled with the powder by repeating the processes of supplying the powder into the stowing container while internally pressurizing the powder supply means and the stowing container and thereafter restoring the atmospheric pressure in the powder supply means and the stowing container as described above.

Third embodiment

Figure 6:
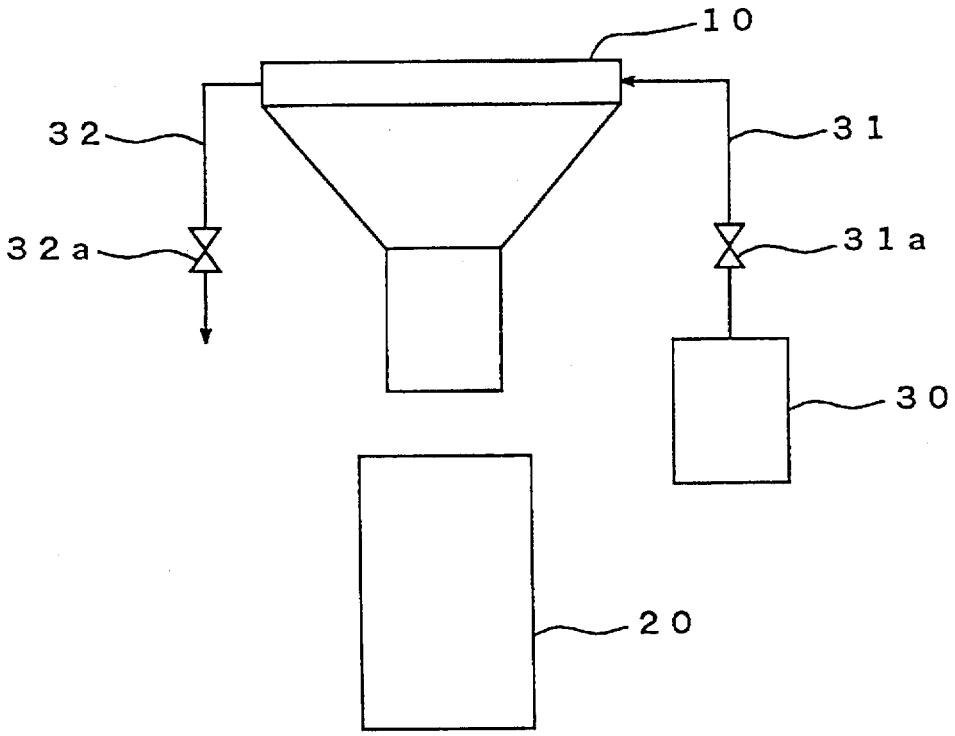
FIG. 6 is a schematic explanatory view showing a state in which a stowing container is filled with a powder supplied from a powder supply means by a powder filling method according to a third embodiment of the present invention.

According to the present embodiment, as shown in FIG. 6, a supply pipe 31 for supplying the air fed from a pressurizing compressor 30 and a discharge pipe 32 for discharging the pressurized air are connected to the powder supply means 10 for supplying a powder 1 such as toner into a stowing container 20, and an upper surface of the powder supply means 10 is made closable.

Furthermore, in the present embodiment, the powder supply means 10 is closed before supplying the powder 1 from the powder supply means 10 to the stowing container 20, and air is supplied from the compressor 30 into the powder supply means 10 through the supply pipe 31 in the above state. After pressurizing the powder 1 in the powder supply means 10, a valve 32*a* provided at the discharge pipe 32 is opened to discharge the air pressurized in the powder supply means 10 to the outside through the discharge pipe 32, thereby restoring the atmospheric pressure in the powder supply means 10.

When the powder supply means 10 is thus internally pressurized, the powder 1 in the powder supply means 10 is compressed to a higher density. Subsequently, when the atmospheric pressure is restored in the powder supply means 10, the air that has existed in the powder 1 is discharged to the outside, so that the bulk density of the powder 1 in the powder supply means 10 is increased.

When the powder 1 having the thus increased bulk density is supplied from the powder supply means 10 into the stowing container 20, the bulk density of the powder 1 to be supplied into the stowing container 20 is also increased, so that the stowing container 20 is internally filled with a greater amount of powder 1 to a high density.

Using the above toner as the powder 1 to be filled in the stowing container 20, a fifth example in which the stowing container 20 is internally filled with the toner by the powder filling method of the present embodiment will be compared below with a fifth comparative example in which the stowing container 20 is internally filled with the toner without performing the restoration of the atmospheric pressure after internally pressurizing the powder supply means 10.

Fifth Example and Fifth Comparative Example

In each of the fifth example and the fifth comparative example, a stowing container 20 having a capacity of 750 cc was used, and the toner was supplied at a supply rate of 60 g/s from the powder supply means 10 into the stowing container 20.

In the fifth example, air was supplied from the compressor 30 through the supply pipe 31 into the powder supply means 10 before supplying the powder from the powder supply means 10 into the stowing container 20. The powder supply means 10 was then internally pressurized at a pressure of 2 kg/cm$^2$, and thereafter the air pressurized in the powder supply means 10 was discharged to the outside through the discharge pipe 32. The atmospheric pressure was restored in the powder supply means 10, and thereafter the stowing container 20 was internally filled with the toner supplied from the powder supply means 10 to a specified height.

On the other hand, in the fifth comparative example, the powder supply means 10 was internally pressurized as described above, and thereafter the toner was supplied from the powder supply means 10 into the stowing container 20 to a specified height without performing the restoration of the atmospheric pressure.

In the fifth example and the fifth comparative example, the filling amount of the toner filled in each stowing container 20 was measured. As a result, the stowing container 20 was internally filled with 300 grams of the toner according to the method of the fifth example, while according to the method of the fifth comparative example the container was filled with only 262 grams of the toner. Therefore, by internally filling the container with the toner in a manner as in the fifth example, the stowing container 20 was allowed to be internally filled with a greater amount of toner to a high density.

According to the third embodiment of the present invention as described above, when the powder supply means stowing therein the powder is internally pressurized, the powder in the powder supply means is compressed to an increased density. Subsequently, when the atmospheric pressure is restored in the powder supply means, the air that has existed in the powder is discharged. When the powder is supplied from the powder supply means into the stowing container in the above state, the powder of which density has increased is supplied into the stowing container. Therefore, the stowing container is allowed to be internally filled to a high density even with a powder such as toner which has a low slack apparent specific gravity relative to its true specific gravity.

As described above in detail, when supplying the powder from the powder supply means into the stowing container to fill the stowing container with the powder, the powder filling method of the present invention comprises the processes of internally pressurizing the powder supply means and the stowing container, discharging the air pressurized in the powder supply means and the stowing container, restoring the atmospheric pressure in the powder supply means and the stowing container, and internally filling the stowing container with the powder. With the above arrangement, the bulk density of the powder filled in the stowing container was increased to allow the stowing container to be easily filled internally with a greater amount of powder to a high density, so that the efficiency of filling the stowing container with the powder was remarkably increased.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A powder filling method for filling a container with powder, comprising:

a first step of supplying the powder from powder supplying means into the container;

a second step of pressurizing air inside the container;

a third step of restoring the air inside the container to an atmospheric pressure; and thereafter, a fourth step of supplying additional powder from powder supply means into the container with the powder supplied in the first step.

2. The powder filling method as claimed in claim 1, wherein said container includes a stowing container for accommodating the supplied powder and a pressure resistant container which accommodates the stowing container.

3. The powder filling method as claimed in claim 1, wherein the second step includes pressurizing air inside the powder supplying means during supplying the powder into the container.

4. The powder filling method as claimed in claim 3, wherein the third step includes restoring the air inside the powder supplying means to an atmospheric pressure.

5. The powder filling method as claimed in claim 4, wherein the step of pressurizing air inside the container occurs during supply the powder into the container.

6. The powder filling method as claimed in claim 5, wherein said powder supplying means is connected with the container by a connection member which seals a connecting portion between the powder supplying means and the container.

7. The powder filling method as claimed in claim 5, further comprising:

a fifth step of pressurizing the air inside the powder supplying means and the container during supplying the powder into the container in the fourth step; and a sixth step of restoring the air inside the powder supplying means and the container to an atmospheric pressure.

8. The powder filling method as claimed in claim 7, wherein the air inside the powder supplying means and the container is pressurized to a first target pressure in said second step and pressurized to a second target pressure which is lower than the first target pressure in said fifth step.

9. The powder filling method as claimed in claim 5, wherein said container includes a stowing container for accommodating the supplied powder and a pressure resistant container provided outside the stowing container.

10. The powder filling method as claimed in claim 1, wherein the powder is toner.

11. A method for increasing a bulk density of powder comprising the following steps of:

supplying a first powder into an airtight space;

pressurizing air of the airtight space;

restoring the air of the airtight space to an atmospheric pressure; and thereafter, supplying additional powder into the airtight space along with the first powder supplied into the airtight space.

12. The method as claimed in claim 11, wherein the powder is toner.

* * * * *